United States Patent [19]

Moser et al.

[11] Patent Number: 4,515,459

[45] Date of Patent: May 7, 1985

[54] PRESS FIXING APPARATUS WITH THREE PRESSING ROLLERS

[75] Inventors: Kurt Moser, Gerlingen; Rolf Hofmann, Leonberg, both of Fed. Rep. of Germany

[73] Assignee: Develop Dr. Eisbein GmbH & Co., Fed. Rep. of Germany

[21] Appl. No.: 478,036

[22] Filed: Mar. 23, 1983

[30] Foreign Application Priority Data

Apr. 1, 1982 [DE] Fed. Rep. of Germany ..... 3212147

[51] Int. Cl.[3] ..... G03G 15/00

[52] U.S. Cl. ..... 355/3 FU; 355/3 R; 355/14 FU

[58] Field of Search ..... 355/3 R, 3 FU, 14 TR, 355/14 FU

[56] References Cited

U.S. PATENT DOCUMENTS 4,192,229 3/1980 Tsunoi et al. ..... 100/158 R

*Primary Examiner*—A. C. Prescott

*Attorney, Agent, or Firm*—Barnes & Thornburg

[57] ABSTRACT

The invention relates to a fixing arrangement for fixing toner images in a photocopying machine or the like. The arrangement includes three pressing rolls or rollers disposed substantially in a common plane and supported together at respective bearing blocks. The bearing blocks are formed as respective single parts at the ends of the rolls and form bearing seats for both outer press rolls and a guide for the bearing of the middle press roll.

20 Claims, 4 Drawing Figures

PRESS FIXING APPARATUS WITH THREE PRESSING ROLLERS

BACKGROUND AND SUMMARY OF THE INVENTION

The invention relates to a press fixing apparatus for the fixing of toner images, with three pressing rolls or rollers having axes disposed substantially in a common plane. The pressing rolls are laterally supported in lateral bearing blocks at their respective ends and are resiliently pressed against one another.

With a known construction of the above-mentioned kind (German published application—DE-AS No. 28 09 750) two pressing rollers forming a clamping slot are carried in lateral bearing blocks in a U-shaped frame, whereby one of the pressing rollers is slidably guided at its ends and is loaded with pressure springs in the direction toward the clamping slot. These resiliently pressed pressing rollers are supported at the diametrically opposite side of the other pressing rollers by means of a support roller, which support roller exhibits a shorter axial length and which is carried in a fixed bearing block at the U-shaped frame, whereby its bearings are pressed with further pressure springs against the middle pressing roller. With this press fixing apparatus there is achieved a resultant reduction in the construction space because the diameter of the pressing rollers can be made smaller. However, the design and manufacturing technology expenditures are relatively high for this construction.

The invention is based upon the problem to so build a press fixing apparatus of the above-mentioned kind that most simple construction is obtained along with a reduction of the necessary construction space. This problem is solved according to the invention in that a common bearing block is provided at each side, for the three pressing rollers which bearing blocks serve to support the bearings for the two outer pressing rollers with spring tension against respective bearing seats, also serve to accommodate a movable guide disposed in a common plane for the bearing of the middle pressing roller.

Through this construction the number of bearing blocks and, above all, also the number of the movable bearings is reduced, while furthermore the number of the elements is reduced which are necessary to facilitate the pressing force.

In especially advantageous embodiments of the invention it is provided that the bearing blocks are respective single part construction pieces which exhibit oppositely disposed somewhat half cylindrical bearing seats for the bearings of the outer pressing rollers, which bearing seats are connected together by means of frame sections or web portions which form a guide for the bearing of the middle pressing roller, whereby at each bearing block one of the frame portions is subdivided by means of a separating gap into two sections which are tensioned with respect to one another by means of at least one spring. This arrangement facilitates a very simple construction of the bearing blocks which is formed without joints and which requires only two springs to bring about the necessary pressing forces. Thereby, it is appropriate and practical if the separating gap or slot between the two sections of one of the frame portions extends into one of the bearing seats. It is also accomplished that an exact guidance is maintained during the relative movement inside of the separating slot.

Practically, the frame portion containing the separating gap exhibits a larger cross section than does the undivided support frame portion.

In further embodiments of the invention it is provided that both lateral bearing blocks are connected with one another by means of cross members extending parallel to the axes of the outer pressing rollers. The cross members serve to accommodate the axial forces. It is advantageous if the cross members—as seen in the direction of the pressing rollers—are disposed in corners of a rectangular that surrounds the middle pressing roller. With this arrangement an especially advantageous force balancing relationship is achieved.

An especially simple assembly is achieved by providing the cross members with limit stops supported at the facing surfaces of the frame support portions of the two bearing blocks and with hook formed protrusions penetrating these frame support portions. Sliders are slidable into the respective hook-formed protrusions, which sliders then abut the oppositely disposed surfaces of the frame support portions of the bearing blocks. In this manner the assembly of the press fixing apparatus as a construction unit is achieved without requiring the use of screws, bolts, or the like.

It is especially advantageous if the protrusions of the cross members exhibit a somewhat triangular shaped cross section in the region extending through the bearing blocks, the sides of which are supported at the surface of the frame members, the outer surfaces of the bearings of the outer pressing rollers and the slide. In this manner the cross members are exactly positioned and furthermore the advantage is achieved that through the level of the slider a positioning of the pressing rollers is achieved so that they can, in this manner, be adjusted so that their cover surfaces are not disturbed or are only lightly disturbed during running without paper.

These and further objects, features, and advantages of the present invention will become more obvious from the following description when taken in connection with the accompanying drawings which show, for purposes of illustration only, a single embodiment in accordance with the present invention.

DETAILED DESCRIPTION OF THE DRAWINGS

Figure 1:
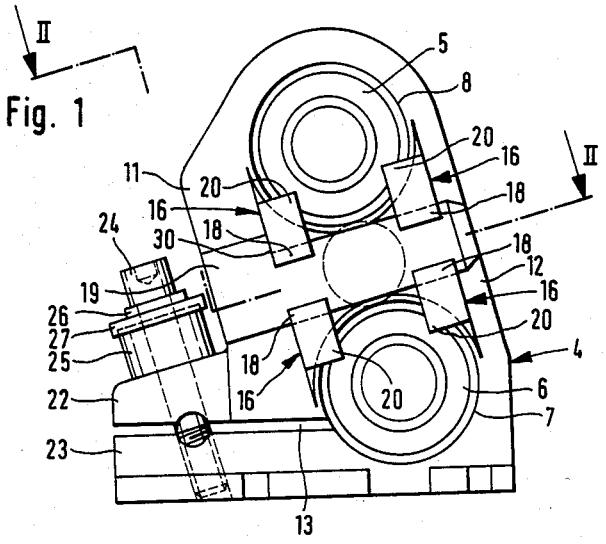
FIG. 1 is a schematic side view of press fixing apparatus with three press rollers constructed in accordance with a preferred embodiment of the invention.

The illustrated press fixing apparatus serves to fix toner images which have been introduced to a sheet of paper or a film or foil. It would especially be introduced in connection with a copying apparatus or a telecopy or similar duplicating apparatus to be used, in which a toner image is introduced to a sheet of paper or a foil, or the like. The press fixing apparatus includes three pressing rollers 1, 2 and 3 which are substantially disposed in a common plane extending perpendicular to the forward feeding direction of the paper or the foil and having a slight inclination to the vertical.

Both outer pressing rollers 1 and 3 extend with their axes parallel to one another and disposed exactly perpendicular to the transport direction. The two outer pressing rollers 1 and 3 advantageously have the same diameter. The middle pressing roller 2, which has a diameter only approximately one half of the diameter of the two outer pressing rollers 1 and 3, is arranged at a slight angle of approximately 2° with respect to the two outer pressing rollers 1 and 3. The inclination is so selected that the axes of the middle roller 2 cuts through the common plane at the longitudinal middle of the rollers. Both outer pressing rollers 1 and 3 clamp the middle pressing roller 2 with a strong pressing pressure between them, as explained in more detail below.

Because of the slightly inclined disposition of the middle pressing roller 2, the two outer pressing rollers 1 and 3 can elastically bend and engage against the middle pressing roller 2 along a line which is not deformed. The pressing rollers 1, 2, and 3 are massive steel rollers. A clamping gap is formed between the pressing roller 1 and the pressing roller 2 as well as between the pressing roller 2 and the pressing roller 3, through which clamping gap a paper sheet or foil can be guided for the fixing of a toner image existing thereon. The pressing roller which comes into contact with the toner image pressing roller 1 in the embodiment illustrated, is advantageously driven. The pressing roller 1 is therefore provided with a coupling or clutch end 21. The pressing roller, which comes into contact with the toner image (pressing roller 1 in the illustrated embodiments) is practically provided with a dull or mat outer surface in order to prevent that a glossy paper sheet is held because of the pressing pressure, which has a special significance if a coated paper is used, for example, with a zinc oxide coated paper, and wherein the toner image is at the coated side.

The pressing rollers 1, 2, and 3 form a preassembled construction assembly with two lateral bearing blocks 4. Each bearing block 4 is constructed as a single part, especially as a pressure diecast metal part. Each block 4 exhibits approximately half cylindrical seats 7 and 8 for the bearings 5 and 6 of the two outer pressing rollers 1 and 3 disposed oppositely to one another, and which by means of two parallel frame portions 11 and 12 are connected with one another. The frame portion or section 11 is provided with a cut out separating slot 13, which extends into the respective bearing seat 7 so that both sides of the separating slot 13 form guide surfaces for the bearing seats. In the region of the separating slot 13, there are protrusions 22 and 23 formed at the frame section 11 (which exhibits a larger cross section than the bearing part frame section 12) which in any case are separated from one another by the separating slot 13. The two protrusions 22 and 23 are forced toward one another with the help of a tensioning screw 24 screwed into the protrusion 23 and extending through the protrusion 22. The head of the tensioning screw 24 is supported by means of an underlying disc 26 and a pressure ring 27 at a pressure spring 25. According to certain preferred embodiments spring 25 is a rubber spring. Instead of a rubber spring the pressure spring 25 can also be formed as a spiral spring, or out of one or more cup springs.

Figure 2:
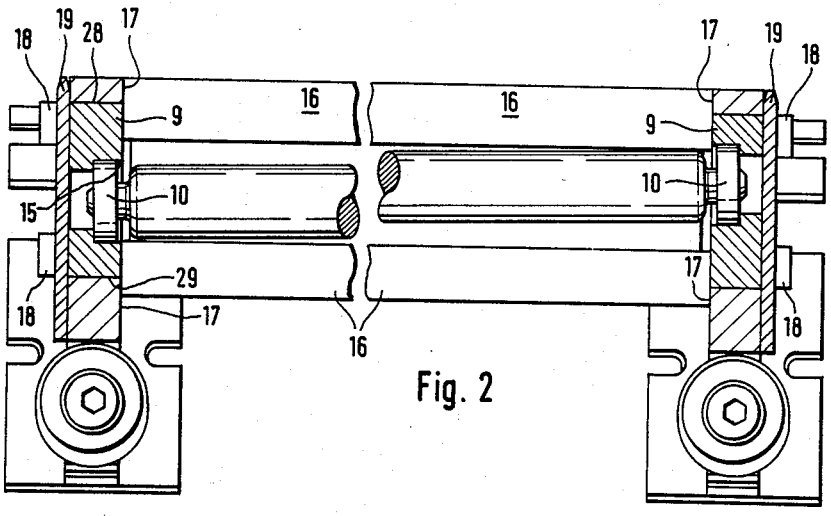
FIG. 2 is a sectional view along line II—II of FIG. 1.

The facing inner surfaces 28 and 29 of the support frame sections 11 and 12, which extend parallel to the common plane of the pressing rollers 1 and 3, form a guidance for a block 9 (FIGS. 2 and 3), in which block 9 the middle pressing roller 2 is supported with a roller bearing 10. The block 9 possesses an angular shoulder for the axial support at the provided bearing reception bore 15. The bearing reception bores 15 are so configured to accommodate the desired inclination angle for the press roller 2, while the outer surfaces of the blocks 9 extend parallel to the guide surfaces 28 and 29 of the support frame sections 11 and 12.

During the travel of a sheet of paper or a foil through the clamping slot between the press rollers 1 and 2 or the press rollers 2 and 3, the bearing blocks 4 deform elastically in the region of the section or web 12 so that no joint or hinge is necessary. In order to assure that a guided movement is obtained, the separating slot 13 extends into the region of the bearing seat 7, so that the portion 11 is guided at the outer ring of the bearing 6 of the lower pressing roller 3.

The two bearing blocks 4 are connected together by means of four cross members 16 which extend parallel to the axes of the two outer pressing rollers 1 and 3 and are arranged at the corners of a rectangle that surrounds the middle pressing roller 2. The preferably pressure cast profile manufactured cross members 16 are disposed with their stop services 17 on the facing surfaces of the respective two bearing blocks 4, whereby their axial position is established. Cross members 16 penetrate the bearing blocks 4 with approximately triangular shaped projections 18 (FIG. 1). One of the surfaces of the cross members 16 abuts against the bearing outer ring of the bearing 5 or 6, a second surface abuts on the inner surfaces 28 and 29 of the frame portions 11 and 12 and the third surface abuts at a slider 19, which is brought into position on the respective opposite outside sidewalls of the bearing blocks 4. With this arrangement, the cross members 16 do not disturb the blocks 9 serving for the support of the bearings for the middle pressing roller 2, and the bearings 5 and 6 of the outer press rollers 1 and 3 are exactly fixed and positioned in the radial direction and in their bearing seats 7 and 8.

The slider 19 is shoved perpendicularly to the common plane of the pressing rollers 1, 2, and 3 into the hook-formed open ends of the protrusions 18. The slider 19, whose inserted end is manually grasped or held, is shoved in from the side of the tensioning bolt 24 and abuts with a stop 30 at one of the protrusions 18 of the cross member 16. In order to assure that the slider 19 remains in the illustrated position, for example, the underlying disc 26 or the pressure disc 27 can be formed as a stop abutment which is disposed in a movement path of the slider 19 so that this can be dismantled only after the removal of the tensioning bolt and the associated parts. The protrusions 18 of the cross members 16 are furthermore provided with protruding protrusions 20 in the direction of the bearings 5 and 6 of the outer pressing rollers 1 and 3, which protrusions 20 serve as axial stops for the outer ring of the bearings 5 and 6 and thereby secure and position these in the axial direction.

The slider 19 is disposed at the outside of the bearing blocks 4 in the region in which the blocks 9 are located, which blocks 9 serve for the bearings of the middle pressing roller. These blocks 9 are supported in the axial direction at the slider 19, whereby the middle pressing roller 2 is positioned in the axial direction by means of the slider 19.

Figure 3:
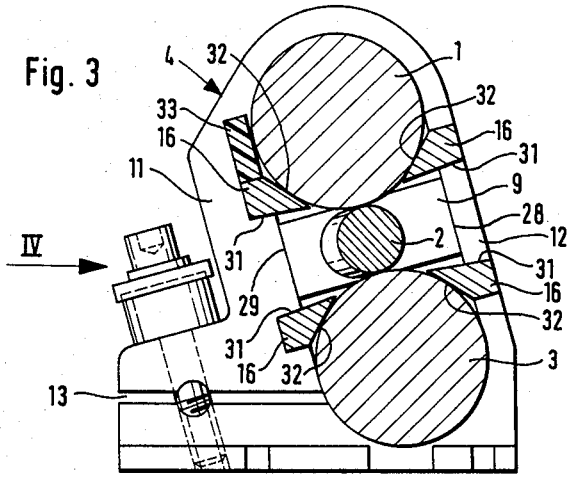
FIG. 3 is a part sectional view through the middle of the press fixing apparatus of FIG. 1.
Figure 4:
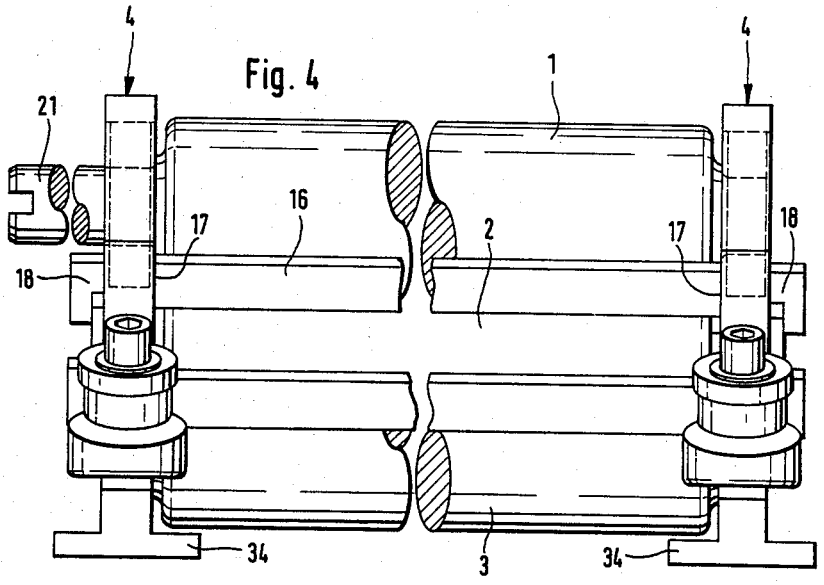
FIG. 4 is a view in the direction of the arrow IV of the press fixing apparatus according to FIG. 3.

In the region between the two bearing blocks 4, the oppositely disposed surfaces 31 of the cross members 16 are arranged to be approximately tangential to the clamping gap between the press rollers 1 and 2 or 2 and 3, so that they can serve as guide surfaces for an incoming or outgoing paper or foil. In certain circumstances these surfaces 31 can also be provided with guide ribs. The surfaces 32 of the cross member 16 facing the pressing rollers 1 and 3 extend tangentially to the pressing rollers 1 and 3, to be sure without touching the same so that they, in any event, can serve as stripping devices. In the region between the bearing blocks 4, there can also be other accessory parts attached, for example, a stripper 33 as shown in FIG. 3. The bearing blocks 4 are provided with foot or bracket parts 34 with which they can be attached to the frame of a copying machine, or the like.

The press fixing apparatus of the invention is formed out of only a very few different parts, which parts can very simply be assembled into the illustrated construction unit. Both pressing rollers 1 and 3 can be constructed identically except for the coupling or clutch stub 21. The two bearing blocks 4 are in any event, formed identically. Also the blocks 9 are identically formed and provided with the bearing reception bores 15. The blocks 9 then installed on 180° with respect to one another at opposite ends of the pressing rollers in order to accomplish the desired slight diagonal mounting of the middle pressing roller 2. Also the cross members 16 all have the same outer form. Similarly the sliders 19 and self understandably also the tensioning bolts 24 and the pressure springs 25 are similar. Other than the connection of the tensioning bolts 24, none of the parts must be connected with one another by screws, or the like, so that an exceptionally simple and therefore exact assembly is possible.

While we have shown and described a single embodiment in accordance with the present invention, it is understood that the same is not limited thereto but is susceptible to numerous changes and modifications as would be known to those skilled in the art of the present disclosure and we therefore do not wish to be limited to the details shown and described therein but intend to cover all such changes and modifications as are encompassed by the scope of the appended claims.

We claim:

1. Pressing roller arrangement for the fixing of toner images in a photocopying machine, or the like, comprising:

three pressing rollers disposed in substantially a common plane and forming clamping gaps for accommodating travel therethrough of paper or foil and the like, said pressing rollers including two outer pressing rollers and a middle pressing roller, and a common bearing block at each respective end of the rollers, said bearing blocks forming resiliently biased bearing seats for the outer pressing rollers and being provided with a guide for the bearing of the middle pressing roller, wherein the bearing blocks are formed as respective unitary building parts which exhibit two oppositely disposed somewhat half cylindrical bearing seats for the bearings of the outer pressing rollers, one of the bearing block portions forming the respective bearing block being divided into two sections with a separating slot therebetween, and wherein at least one spring is provided for resiliently tensioning said sections with respect to one another at said slot.

2. Arrangement according to claim 1, wherein said bearing seats are connected by web portions of the bearing blocks which also form the guide for the bearings of the middle pressing roller.

3. Arrangement according to claim 2, wherein the separating slot between the two sections of one of the bearing block portions extends into one of the bearing seats for the outer pressing rollers.

4. Arrangement according to claim 3, wherein the bearing block portion which includes the separating slot exhibits a larger cross section than the undivided bearing block portion.

5. Arrangement according to claim 2, wherein a guide block is accommodated between the two portions of each bearing block, which guide block includes a bearing reception bore for a bearing of the middle pressing roller.

6. Arrangement according to claim 4, wherein a guide block is accommodated between the two portions of each bearing block, which guide block includes a bearing reception bore for a bearing of the middle pressing roller.

7. Arrangement according to claim 5, wherein the middle pressing roller is arranged with its axis at an angle with respect to the respective parallelly extending axes of the outer pressing rollers, for which purpose the guide blocks which contain the bearings for the middle pressing roller are provided with diagonally disposed bearing reception bores.

8. Arrangement according to claim 2, wherein the two laterally disposed bearing blocks are connected to one another by means of cross members which extend parallel to the axes of the outer pressing rollers.

9. Arrangement according to claim 4, wherein the two laterally disposed bearing blocks are connected to one another by means of cross members which extend parallel to the axes of the outer pressing rollers.

10. Arrangement according to claim 7, wherein the two laterally disposed bearing blocks are connected to one another by means of cross members which extend parallel to the axes of the outer pressing rollers.

11. Arrangement according to claim 8, wherein the cross members—as viewed in the direction of the pressing rollers—are disposed at the corner points of a rectangle which surrounds the middle pressing roller.

12. Arrangement according to claim 10, wherein the cross members—as viewed in the direction of the pressing rollers—are disposed at the corner points of a rectangle which surrounds the middle pressing roller.

13. Arrangement according to claim 11, wherein the cross members are supported with limit stops engageable on the facing surfaces of the portions of the respective two bearing blocks, said cross members penetrating with projections through the bearing blocks to accommodate attachment thereto of a slide shovable into hook-formed protrusions on the projections, said slides being disposed on the opposite lateral outside walls of the bearing blocks.

14. Arrangement according to claim 2, wherein the cross members are supported with limit stops engageable on the facing surfaces of the portions of the respective two bearing blocks, said cross members penetrating with projections through the bearing blocks to accommodate attachment thereto of a slide shovable into hook-formed protrusions on the projections, said slides being disposed on the opposite lateral outside walls of the bearing blocks.

15. Arrangement according to claim 14, wherein the slides serve as axial stops for the guide blocks disposed between the bearing block portions, which guide blocks include bearing reception bores for the bearings of the middle pressing roller.

16. Arrangement according to claim 14, wherein the slides serve as axial stops for the guide blocks disposed between the bearing block portions, which guide blocks include bearing reception bores for the bearings of the middle pressing roller.

17. Arrangement according to claim 13, wherein the protrusions of the cross members are provided with axial stops for the outer pressing roller bearings in the region of these bearings.

18. Arrangement according to claim 13, wherein the protrusions of the cross members exhibit a somewhat triangular shaped cross section in the region extended through the bearing blocks, which cross section sides respectively support the inner surface of the bearing block portions, the outer surfaces of the bearings for the outer pressing rollers, and the slide.

19. Arrangement according to claim 18, wherein the respective opposite surfaces of the cross members extend somewhat tangentially to the clamping slot between the outer pressing rollers and the middle pressing roller in the region between the bearing blocks.

20. Arrangement according to claim 8, wherein the respective opposite surfaces of the cross members extend somewhat tangentially to the clamping slot between the outer pressing rollers and the middle pressing roller in the region between the bearing blocks.

* * * * *